US008435094B2

(12) United States Patent
Amadio et al.

(10) Patent No.: US 8,435,094 B2
(45) Date of Patent: May 7, 2013

(54) MODULAR TOY VEHICLE

(75) Inventors: Donald W. Amadio, Oaklyn, NJ (US); James V. Mendillo, Medford, NJ (US); Yuk Kei Chan, New Territories (HK)

(73) Assignee: Ridemakerz, LLC, Irvine, CA (US)

( * ) Notice: Subject to any disclaimer, the term of this patent is extended or adjusted under 35 U.S.C. 154(b) by 58 days.

(21) Appl. No.: 13/027,599

(22) Filed: Feb. 15, 2011

(65) Prior Publication Data

US 2011/0143630 A1 Jun. 16, 2011

Related U.S. Application Data

(60) Continuation of application No. 12/490,307, filed on Jun. 23, 2009, now Pat. No. 7,896,724, which is a division of application No. 11/735,980, filed on Apr. 16, 2007, now Pat. No. 7,568,962.

(51) Int. Cl.
*A63H 17/00* (2006.01)
*A63H 17/26* (2006.01)

(52) U.S. Cl.
USPC ..... 446/94; 446/95; 446/470; 446/471

(58) Field of Classification Search ..... 361/679, 361/724, 725, 727; 446/91, 94, 95, 431, 446/438, 456, 462, 465, 470, 471
See application file for complete search history.

(56) References Cited

U.S. PATENT DOCUMENTS

| | | | |
|---|---|---|---|
| 2,609,268 | A | 9/1952 | Nye |
| 2,691,724 | A | 10/1954 | Hoffman |
| 2,879,491 | A | 3/1959 | Shapiro |
| 3,094,364 | A | 6/1963 | Liagg |
| 3,696,548 | A | 10/1972 | Teller |
| 4,183,173 | A | 1/1980 | Ogawa |
| 4,188,748 | A | 2/1980 | Rich |
| 4,236,190 | A | 11/1980 | Hollingsead et al. |
| 4,406,085 | A | 9/1983 | Rhodes |
| 4,488,375 | A | 12/1984 | Cheng |
| 4,504,239 | A | 3/1985 | Kulesza et al. |

(Continued)

FOREIGN PATENT DOCUMENTS

| | | | |
|---|---|---|---|
| GB | 2 234 687 | A | 2/1991 |
| JP | 60-47600 | A | 4/1985 |

(Continued)

OTHER PUBLICATIONS

European Search Report application No. 07799724.5 dated Jan. 17, 2012.

*Primary Examiner* — John Ricci
(74) *Attorney, Agent, or Firm* — Squire Sanders (US) LLP

(57) ABSTRACT

A modular toy vehicle design having a universal mating system between the body of the vehicle and the chassis such that multiple body styles will interchangeably mate with multiple chassis designs and where electrical interfaces are automatically established between the body and the chassis simply by mating and aligning the two together. The design allows for an electrical connection to be made in the process of mechanically mating and aligning the body of a toy vehicle to its chassis thereby powering electronic features that are physically connected to the body with the power source which is housed in the chassis. When the body is properly aligned and mounted, the electrical interfaces are automatically established. There is no separate step of plugging together mating connectors where one connector extends from a wire bundle electrically interfacing with the body and the mating connector extends from a separate wire bundle electrically interfacing with the chassis.

13 Claims, 4 Drawing Sheets

U.S. PATENT DOCUMENTS

| | | | |
|---|---|---|---|
| 4,530,670 | A | 7/1985 | Ohno |
| 4,559,022 | A | 12/1985 | Herstein |
| 4,571,202 | A | 2/1986 | Diebold |
| 4,764,150 | A | 8/1988 | Uchino |
| 4,919,639 | A | 4/1990 | Hesse |
| 4,993,983 | A | 2/1991 | Kurita |
| 5,352,147 | A | 10/1994 | Nagel |
| 6,033,285 | A | 3/2000 | Fine |
| 6,364,509 | B1 | 4/2002 | Johnson, III |
| 6,679,753 | B1 | 1/2004 | Motosko |
| 6,758,718 | B1 | 7/2004 | Morris |
| 6,773,321 | B1 | 8/2004 | Urquiaga |
| 6,840,839 | B2 | 1/2005 | Rehkemper et al. |
| 7,100,968 | B2 | 9/2006 | Mataja |
| 2005/0042974 | A1 | 2/2005 | Agostini et al. |
| 2006/0150918 | A1 | 7/2006 | Rowe |

FOREIGN PATENT DOCUMENTS

| | | | |
|---|---|---|---|
| JP | 3-54795 | B | 6/1987 |
| JP | 6-1195 | B | 9/1988 |
| JP | 6-39754 | B | 4/1991 |
| JP | 3028460 | B | 6/1996 |
| JP | 2004-057493 | A | 2/2004 |
| WO | 03092844 | A1 | 11/2003 |

MODULAR TOY VEHICLE

RELATED APPLICATIONS

This Application is a continuation of U.S. patent application Ser. No. 12/490,307, filed Jun. 23, 2009, the specification of which is hereby incorporated by reference, which is a divisional application of U.S. patent application Ser. No. 11/735,980, filed Apr. 16, 2007, (U.S. Pat. No. 7,568,962), the disclosure of which is hereby incorporated by reference.

FIELD OF THE INVENTION

This invention relates generally to toy vehicles and, more particularly, to toy vehicles having a modular design.

BACKGROUND INFORMATION

Radio-controlled (RC) cars as well as other toy cars, have been very popular with children of various ages over the years. However, a disadvantage of many toy cars is that generally speaking they are fixed in design and cannot be changed. This means that a child can often become bored with them after a period of time. Furthermore, many children express satisfaction with being able to build or work on a toy themselves. Yet, many radio-controlled cars and other toy cars have a complex construction and have components which are complicated and not easily adapted to be built or switched out by children. What is needed is a toy vehicle having universally and easily interchangeable components such that a child may be able to build or customize their own toys.

Attempts have been made to design toy vehicles with interchangeable components, however, the interchangeable modules for a given vehicle design can each have a distinctly different attachment mechanisms. For example, for a given vehicle, there can be multiple types of attachment mechanisms for the front bumper area of the vehicle and a totally different set of attachment mechanisms for the sides and rear of the vehicle. A more simple design is needed for attachments and accessories where the attachment mechanisms are more universal and easy for children of all ages to install.

Attempts have been made to develop less complex designs and with more universal attachment mechanisms, however, the designs are quite convoluted in that a child can place any accessory at any location on the toy vehicle, even at locations where the accessory is not intended to be installed. A design is needed where the attachment mechanisms are universal, but the design is such that accessories can only be installed at their intended locations. Further, many attempts to develop a design that addresses this need has resulted in a design with a less than appealing appearance having unsightly holes or contact points at locations that take away from the appearance of the vehicle, particularly when an accessory is not installed. This is particularly important when the owner of the toy vehicle is concerned about whether the appearance of the vehicle closely mimics the appearance of a full size vehicle. Unsightly holes or contact points all over the vehicle negates the attempt to mimic the appearance of a full size vehicle.

Further, the attempts to develop a design having interchangeable accessories and attachments have not provided mechanisms for supplying power to accessories, such as for example, providing power to accessories having LED lights and/or sound emitting devices. There are various toy vehicle designs that exist that include light emitting and/or sound emitting devices, however, these devices are not interchangeable accessories.

SUMMARY OF THE INVENTION

The invention is a modular toy vehicle design having a universal mating system between the body of the vehicle and the chassis such that multiple body styles will interchangeably mate with multiple chassis designs and where electrical interfaces are automatically established between the body and the chassis simply by mating and aligning the two together. The design allows for an electrical connection to be made in the process of mechanically mating and aligning the body of a toy vehicle to its chassis thereby powering electronic features that are physically connected to the body with the power source which is housed in the chassis. When the electrical interfaces of the body and chassis are properly aligned and connected, the electrical interfaces are automatically established and the body and chassis are automatically properly aligned, including the chassis mounting posts and body mounting posts. There is no separate step of plugging together mating connectors where one connector extends from a wire bundle electrically interfacing with the body and the mating connector extends from a separate wire bundle electrically interfacing with the chassis.

The present invention is designed for a business model where the toy vehicle bodies can be sold separately from the chassis, giving the customer a choice of several chassis on which to attach a selected vehicle body. The vehicle bodies can have built in working LED headlights and tail lights, but no power source. The power source can be contained within the various chassis designs. The body can also have a sound initiation button such that when the button is depressed and the vehicle body and chassis are properly aligned, the initiation button will electrically contact a mating contact on the chassis to initiate a function, for example, a lighting/sound/motion sequence.

Traditionally, the connection chassis and boy are made by male and female connector clips which are attached to the power source and the wire leads for the lights, respectively. This is a practical solution for a business model where the chassis and body can be sold separately. This requires that the user be in direct contact with wiring and also results in loose hanging electrical wires within the vehicle housing, which can be unsightly and a potential shock hazard, and more susceptible to damage.

The purpose of the automatic mating of the power connector is three-fold; safety, aesthetics and, most importantly, as a guide to assist in the proper alignment of the male and female connection posts between the vehicle body and chassis. So when the power connector's male and female parts are mated, all other connecting points also mate perfectly thereby making for a true connection between the upper body and lower chassis.

The design assists in proper alignment of connection posts; provides large, easy to attach connectors (as compared to typical small battery connectors); eliminates the need for separate power sources; and is shock resistant. Plastic toy vehicles typically consist of two main parts; the body and the chassis (which contains the wheels, motor, etc. These two parts are typically connected by a number of strategically positioned posts (for structural integrity). These posts have male and female ends that mate and are held together by small screws. This assembly operation is usually done in factories and not by the end user.

Toy vehicles with electronic features require a power source and wiring that runs from the power source to the electronic component. Again, this is usually done at the factory level and the end user has little if any direct involvement with electronic wiring. In cases when there is a need for the consumer to complete a connection, the manufacturer builds in small plastic connectors that the consumer can connect. This can often be frustrating because the connectors are small and are often difficult to attach and detach.

The present business model requires that the toy vehicle bodies and chassis be sold separately. So there is the problem of relying on the consumer (often children ages 6 and up in our case) to properly align the body and chassis posts and to make the necessary electrical connections.

The design consists of oversized male and female electronic connectors that are molded into the chassis and vehicle body respectively. Wire leads run from the battery compartment through the interior of the chassis into the male electrical connector. Similarly, wire leads from the electronic components inside the body are connected to the female electrical connector attached to the body. When the two connectors are mated, the posts on the body and chassis alternately align, thereby ensuring a true connection between the two parts.

The elimination of any exposed wires running from the batter source greatly reduce the potential for shock. Also, there is no danger of shock by touching copper conductors on the male contact. The sound initiation push button can be aligned with contact on the chassis. Please refer to the enclosed drawings for further details relating to this invention.

One embodiment of the present invention is a modular toy vehicle comprising a toy vehicle body having an interior body underside conformed to mount over a toy vehicle chassis where said interior body underside has a body alignment electrical connector interface extending from the interior body underside. The toy vehicle body can further have a first guide member extending from the interior underside thereby defining a first mechanical line of engagement, and where said body alignment electrical connector integrally molded into and aligned with the toy vehicle body thereby aligning the first mechanical line of engagement to be congruent with a first predetermined line of engagement. The toy vehicle chassis can have a protruding flattened tab chassis alignment electrical connector interface mateable to said body alignment electrical connector interface and extending from a top side of the toy vehicle chassis. The toy vehicle chassis can further have a second guide member defining a second mechanical line of engagement, where said protruding flattened tab chassis alignment electrical connector integrally molded into and aligned with the toy vehicle chassis thereby aligning the second mechanical line of engagement to be congruent with a second predetermined line of engagement.

The body alignment electrical connector interface can be mated with said protruding flattened tab chassis alignment electrical connector interface thereby aligning congruently the first and second predetermined lines of engagement thereby automatically aligning, electrically connecting and mounting the vehicle body and chassis. The protruding flattened tab chassis alignment electrical connector interface can have one or more exterior surface contact(s) electrically connecting to a body connector contact disposed on an interior of the body alignment electrical connector interface when mounted thereby electrically connecting power from a power source contained in said toy vehicle chassis to a device requiring electrical power to operate that is attached on said toy vehicle body. The device can be a light or other device requiring electrical power for operation.

These and other advantageous features of the present invention will be in part apparent and in part pointed out herein below.

BRIEF DESCRIPTION OF THE DRAWINGS

For a better understanding of the present invention, reference may be made to the accompanying drawings in which.

Figure 1:
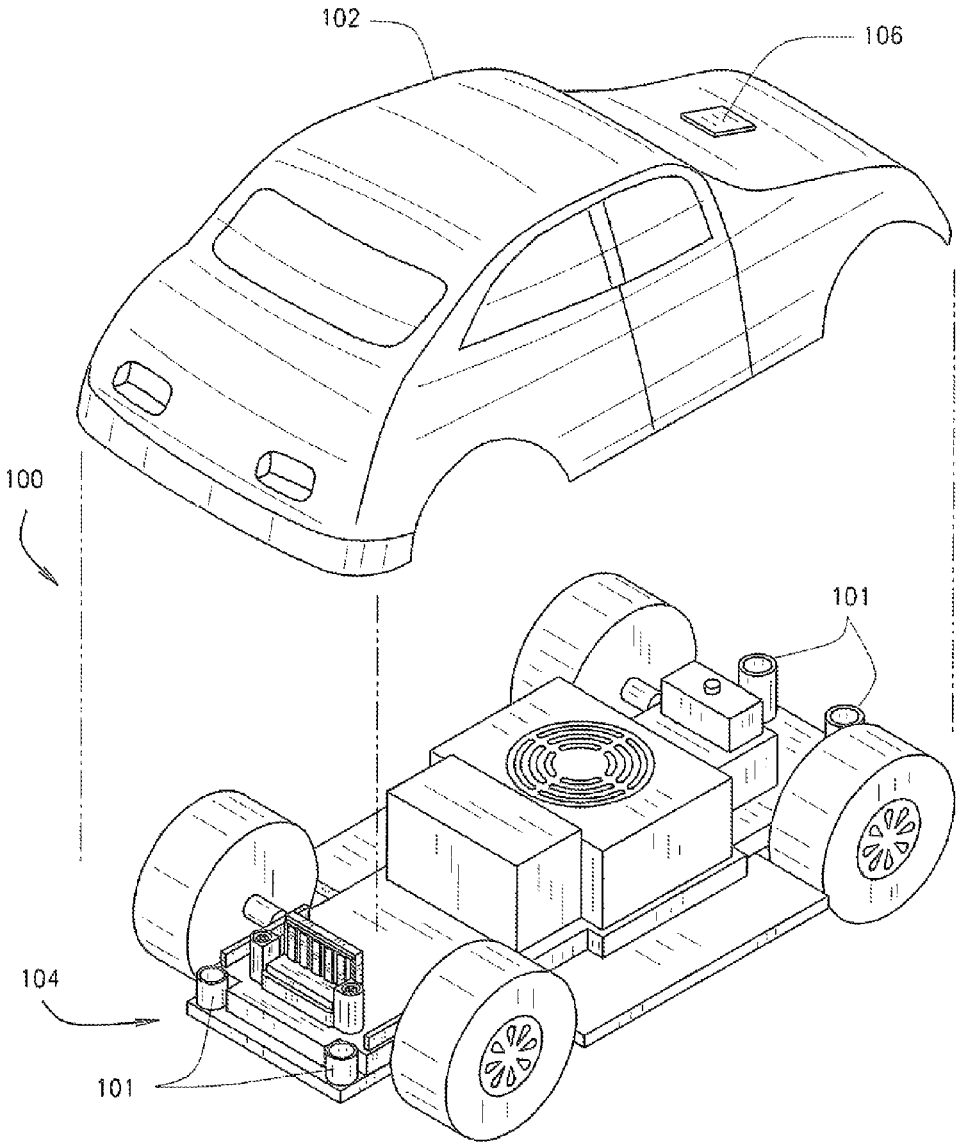
FIG. 1 is top-side exploded perspective view of a body and chassis.

While the invention is susceptible to various modifications and alternative forms, specific embodiments thereof are shown by way of example in the drawings and will herein be described in detail. It should be understood, however, that the drawings and detailed description presented herein are not intended to limit the invention to the particular embodiment disclosed, but on the contrary, the intention is to cover all modifications, equivalents, and alternatives falling within the spirit and scope of the present invention as defined by the appended claims.

DETAILED DESCRIPTION

According to the embodiment(s) of the present invention, various views are illustrated in FIG. 1-7 and like reference numerals are being used consistently throughout to refer to like and corresponding parts of the invention for all of the various views and figures of the drawing. Also, please note that the first digit(s) of the reference number for a given item or part of the invention should correspond to the FIG. number in which the item or part is first identified.

One embodiment of the present invention comprising a modular body and chassis teaches a novel apparatus and method for a toy vehicle having a universal mating system between the body of the vehicle and the chassis such that multiple body styles will interchangeably mate with multiple chassis designs and where electrical interfaces are automatically established between the body and the chassis simply by mating and aligning the two together.

Figure 2:
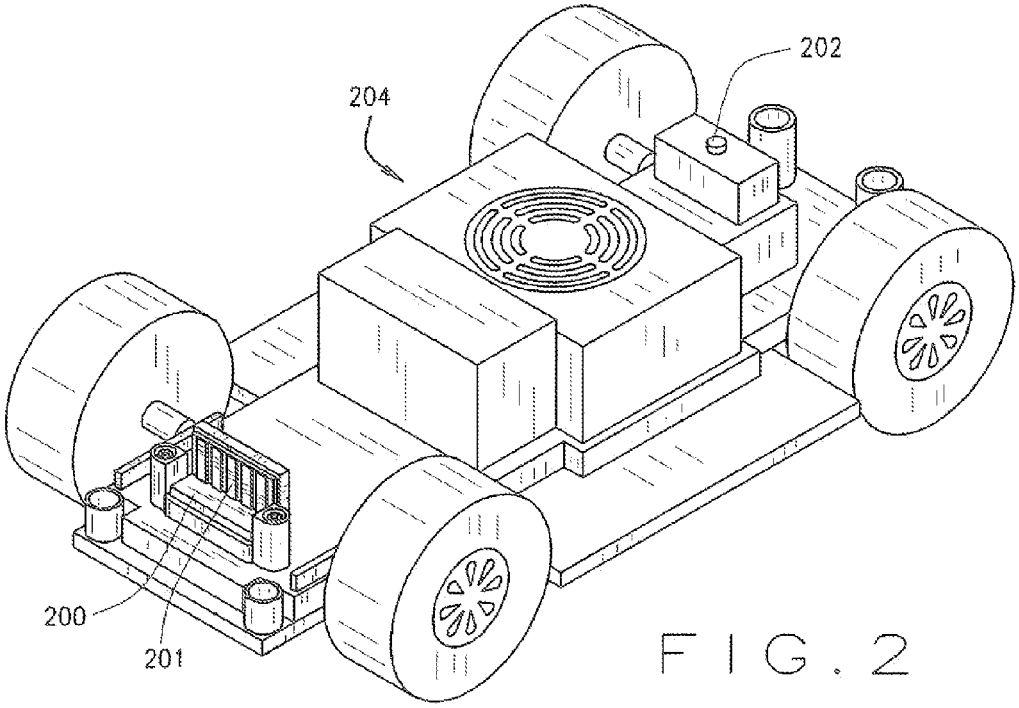
FIG. 2 is a top-side perspective view of the chassis.
Figure 3:
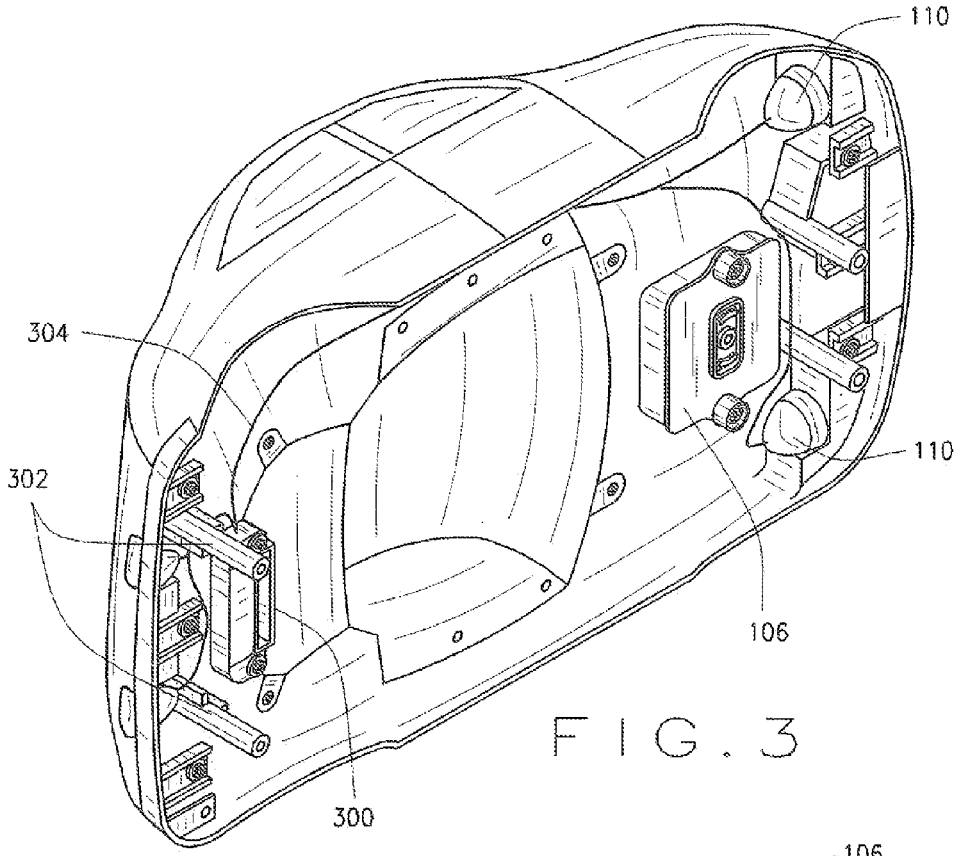
FIG. 3 is a bottom-side perspective view of the body.
Figure 4:
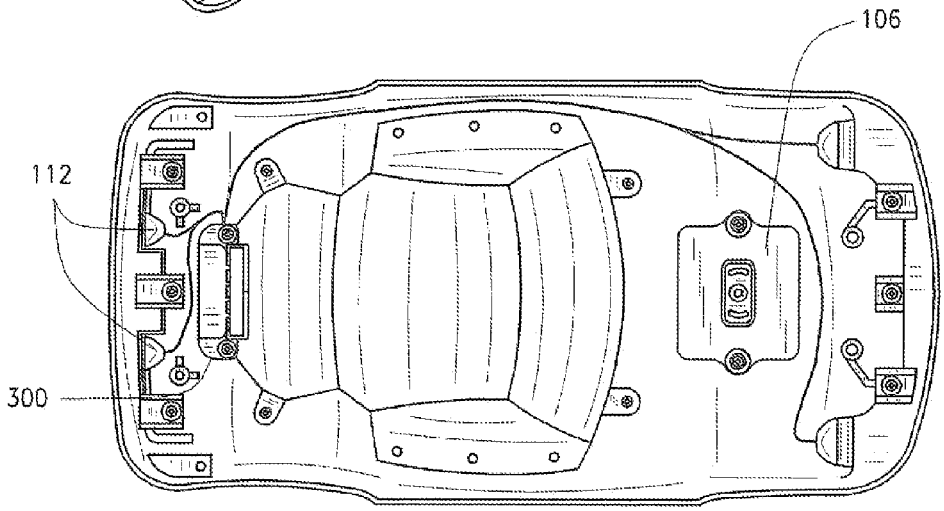
FIG. 4 is a bottom plan view of the body.

The details of the invention and various embodiments can be better understood by referring to the figures of the drawing. Referring to FIG. 1, an exploded top side perspective view of a body and chassis is shown. The exploded view of a toy vehicle 100 reveals a body portion 102 and a chassis portion 104. The body includes an interior body underside conformed to mount over the chassis as shown when properly aligned. The body can be designed for various car styles thereby giving the toy vehicle a certain exterior appearance. The vehicle chassis provides for vehicle mobility. The chassis can typically include four wheels and the wheels can be powered by a motor contained in the chassis or the wheels can be free rotating wheels that requires the user to push the vehicle to initiate mobility. The chassis can also have a vehicle power source as needed. The toy vehicle can also include a sound initiation actuator 106, shown here as being generally located in the area which can be referred to as the hood area. When this actuator is depressed, the toy vehicle can initiate a sound sequence. This exploded view also reveals the chassis mounting post 101 through which screws are threaded for attaching the body to the chassis. The body can also include headlights 110 and taillights 112 that can be powered by the chassis power source. An electrical connection between the chassis and the vehicle body can be established when the electrical interfaces are properly aligned and the body and chassis are properly aligned and mounted. The electrical connection allows for power to be provided to the headlights 110 and the taillights 112. The body could include various other lights that could also be powered after connection between the chassis and body has been established. Referring to FIG. 2, a topside perspective view of the chassis is shown. The chassis can include a chassis connector 200. The embodiment of the chassis connector 200 shown is configured as a protruding tab that can be inserted into a female connector located on the vehicle body. The tab-like connector extends upward from the vehicle chassis in order to properly engage the mated connector located on the body. This view of the chassis also reveals the sound button 202 that can be aligned and contacted by the sound initiation actuator 106 when it is depressed downward. When the sound initiation actuator 106 is depressed, it will contact the sound button 202 thereby depressing the sound button to initiate a sound sequence. A power source 204 is also located in the chassis. The power signals as well as control signals can be sent from the chassis through the chassis connector 200 to the vehicle body. The connector 200 can have multiple contacts for transmitting various signal types. FIG. 3 shows a bottom side perspective view of the body which reveals the mating body connector 300 that is designed to receive the chassis connector 200. The body connector 300 shall include corresponding contacts 301 for mating with the contacts 201 of the chassis connector. This view of the body also reveals the body mounting post 302 whereby the body can be mounted on the chassis by way of a screw or other attachment means. This view also reveals the electrical lines 304 that extend from the body connector to the respective lights or other items requiring power. FIG. 4 is a further illustration providing a bottom plan view of the vehicle body. FIG. 5 is yet again another further illustration revealing the chassis design.

Figure 5:
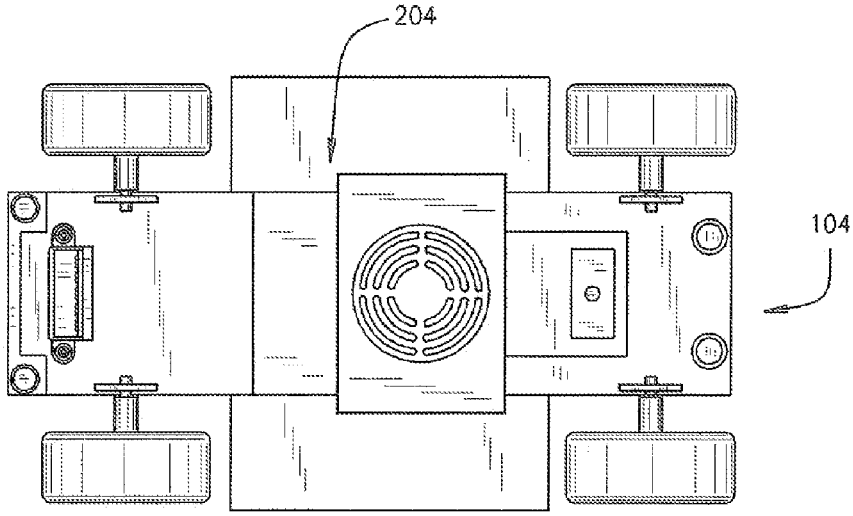
FIG. 5 is a top plan view of the chassis.
Figure 6:
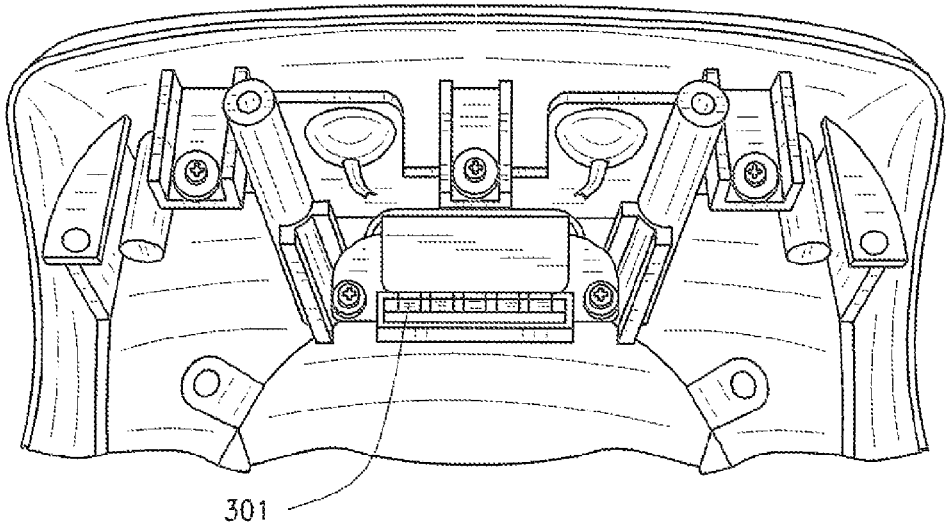
FIG. 6 is a perspective view of the connector.
Figure 7:
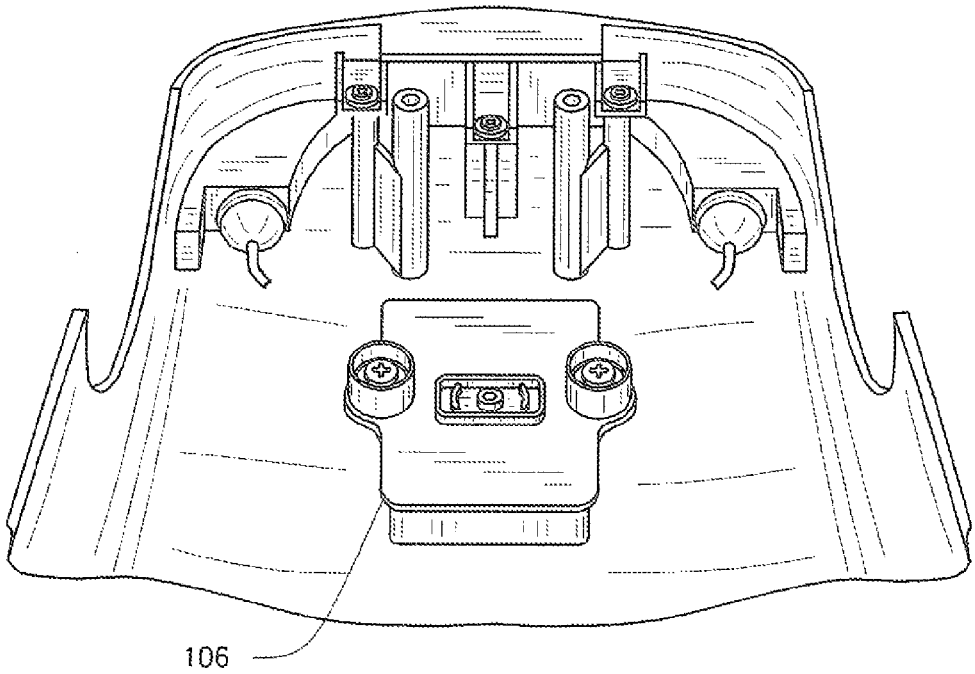
FIG. 7 is a perspective view of the sound initiation push button.

Referring to FIG. 6, a perspective view of the chassis connector is shown. This flattened tab-like connector 200 can have exterior surface contacts 201 as shown. These surface contacts can be thin copper runs or other types of contacts that can make electrical contact with the corresponding contacts 301 of the body connector. When the vehicle is properly aligned and mounted, the chassis connector and the body connector will properly mate. A perspective view of the sound button 106 is also shown in FIGS. 2 and 5. This sound button is also properly aligned with the sound initiation actuator 106 attached to the vehicle body. When this sound button is depressed, the vehicle can be initiated to produce a sequence of sounds that are previously stored.

The various modular toy vehicle examples shown above illustrate a novel design for a vehicle having interchangeable bodies. A user of the present invention may choose any of the above modular vehicle embodiments, or an equivalent thereof, depending upon the desired application. In this regard, it is recognized that various forms of the subject modular vehicle invention could be utilized without departing from the spirit and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A toy vehicle comprising:

a vehicle body comprising a first portion of a mating connector;

a vehicle chassis comprising a second portion of the mating connector;

wherein the first portion is configured to mate with the second portion when the vehicle body is coupled to the vehicle chassis;

wherein a mating of the first portion with the second portion causes the vehicle body to be properly aligned with the vehicle chassis and an electrical connection to be formed between the vehicle body and the vehicle chassis;

wherein at least one of either the first portion or the second portion comprises a tab, and at least one of either the first portion or the second portion comprises a slot, wherein the tab comprises exterior surface electrical contacts.

2. The toy vehicle of claim 1, the vehicle chassis comprising a power supply, wherein the mating provides power from the power supply to the vehicle body.

3. The toy vehicle of claim 1, wherein the mating provides the transmission of electrical signals from the vehicle chassis to the vehicle body.

4. The toy vehicle of claim 1, wherein the mating connector is universal and a plurality of vehicle bodies can be coupled to the vehicle chassis through the second portion.

5. The toy vehicle of claim 1, wherein the mating connector is universal and a plurality of vehicle chassis can be coupled to the vehicle body through the first portion.

6. A toy vehicle comprising:

a vehicle body;

a vehicle chassis;

a universal mating system having a first part directly coupled to the chassis and a second part directly coupled to the body;

wherein the first part is adapted to be coupled to the second part through the universal mating system and wherein the coupling causes the body to be aligned with the chassis and an electrical connection to be formed between the body and the chassis;

wherein at least one of either the first part or the second part comprises a tab, and at least one of either the first part or the second part comprises a slot, wherein the tab comprises exterior surface electrical contacts.

7. The toy vehicle of claim 6, wherein the first part is coupled to the second part by inserting the tab into the slot.

8. The toy vehicle of claim 6, wherein the chassis comprises a power supply that provides power to the body when the first part is coupled to the second part through the universal mating system.

9. The toy vehicle of claim 6 wherein universal mating system provides the transmission of electrical signals from the vehicle chassis to the vehicle body.

10. A method of assembling a toy vehicle comprising:

selecting one of a plurality of toy vehicle chassis, each of the chassis comprising a first part of a universal mating system;

selecting one of a plurality of toy vehicle bodies, each of the bodies comprising a second part of a universal mating system;

coupling the selected chassis to the selected body through the universal mating system, wherein the coupling causes the body to be aligned with the chassis and an electrical connection to be formed between the body and the chassis;

wherein the first part is coupled to the second part by inserting the first part into the second part.

11. The method of claim 10, wherein the selected chassis comprises a power supply that provides power to the selected body when the first part is coupled to the second part through the universal mating system.

12. The method of claim 10, wherein the first part comprises a tab.

13. The toy vehicle of claim 10, wherein universal mating system provides the transmission of electrical signals from the vehicle chassis to the vehicle body.

* * * * *